US005540562A

United States Patent [19]

Giter

[11] Patent Number: 5,540,562

[45] Date of Patent: Jul. 30, 1996

[54] SINGLE-PISTON, MULTI-MODE FLUID DISPLACEMENT PUMP

[75] Inventor: Gerston Giter, St. Paul, Minn.

[73] Assignee: Ashirus Technologies, Inc., Minneapolis, Minn.

[21] Appl. No.: 234,282

[22] Filed: Apr. 28, 1994

[51] Int. Cl.[6] ..... F04B 49/06

[52] U.S. Cl. ..... 417/254

[58] Field of Search ..... 417/254, 267, 417/268, 538

[56] References Cited

U.S. PATENT DOCUMENTS

| | | | |
|---|---|---|---|
| 1,393,085 | 10/1921 | Carpenter | 417/268 |
| 1,695,305 | 12/1928 | Upton | 92/168 X |
| 2,383,324 | 8/1945 | Le Clair | 103/154 |
| 2,396,602 | 3/1946 | Posch | 123/139 |
| 2,508,253 | 5/1950 | Haggardt | 417/254 |
| 2,889,108 | 6/1959 | Alderson | 417/254 |
| 3,036,529 | 5/1962 | Archer | 417/254 X |
| 3,155,041 | 11/1964 | Green | 417/268 X |
| 3,168,045 | 2/1965 | Sebatiani | 103/44 |
| 3,333,548 | 8/1967 | Lyshkow | 103/154 |
| 3,471,079 | 10/1969 | Myers | 230/53 |
| 3,695,788 | 10/1972 | Loomans | 417/488 |
| 3,704,080 | 11/1972 | Cross | 417/486 |
| 3,802,805 | 4/1974 | Roeser | 417/398 |
| 3,913,787 | 10/1975 | Dilger | 222/26 |
| 4,090,818 | 5/1978 | Hope et al. | 417/473 |
| 4,242,058 | 12/1980 | Zakora | 414/437 |
| 4,255,096 | 3/1981 | Coker, Jr. et al. | 417/415 |
| 4,449,897 | 5/1984 | Garrett | 417/437 |
| 4,493,614 | 1/1985 | Chu et al. | 417/22 |
| 4,566,868 | 1/1986 | Menzies | 417/572 |
| 4,568,249 | 2/1986 | Todd | 417/238 |
| 4,657,488 | 4/1987 | Weinhandl | 417/267 |
| 4,682,712 | 7/1987 | Bohnensieker | 222/137 |
| 4,715,791 | 12/1987 | Berlin et al. | 417/274 |
| 4,730,992 | 3/1988 | Ogawa | 417/465 |
| 4,941,808 | 7/1990 | Qureshi et al. | 417/415 |

FOREIGN PATENT DOCUMENTS

| | | | |
|---|---|---|---|
| 611 | 2/1979 | European Pat. Off. | 417/254 |
| 1613677 | 12/1990 | U.S.S.R. | 417/254 |
| 556538 | 10/1944 | United Kingdom . | |

*Primary Examiner*—Richard E. Gluck

*Attorney, Agent, or Firm*—Palmatier, Sjoquist & Helget, P.A.

[57] ABSTRACT

A single-piston, multimode fluid displacement pump comprising an elongated chamber, a piston reciprocally mounted within the chamber, a driving mechanism axially aligned with the chamber and piston for accurately positioning the piston within the chamber so as to define a measured fluid displacement, and ports for aspirating and dispensing fluid.

19 Claims, 3 Drawing Sheets

SINGLE-PISTON, MULTI-MODE FLUID DISPLACEMENT PUMP

BACKGROUND OF THE INVENTION

In applications such as medical laboratory and process instrumentation, it is often necessary to provide precisely measured quantities of a sample, diluents, or reagents. For example, a very small quantity of sample, i.e. several microliters, might be diluted with several hundred microliters of buffer before being mixed with a quantity of reagent.

Very accurate dosages of sample, diluent, and reagent have traditionally been provided by fluid displacement pumps. Such pumps very accurately measure the quantity of fluid displaced. In order to measure fluid displacement accurately, it is necessary to have a precisely machined pump cylinder and piston and a precise mechanism for driving the piston to displace the fluid.

Typically, two different pumps are needed: one for the very small quantity of sample and another for the much larger quantity of diluent. Furthermore, it is typical for the precise driving mechanism to be off-axis from the cylinder and connected to the piston by some mechanical linkage such as pulleys and drive belts. Because the driving mechanism is off-axis, it may introduce substantial strain against the piston, leading to early failure due to wear on the pump seals.

There is a need for a fluid displacement pump which can accept pistons and chambers of varying size, depending on the quantity of fluid needed to be measured. Ideally, such a pump would be able to dispense both a large quantity of diluent and a tiny quantity of sample. Additionally, the pump should have a precision driving mechanism axially aligned with the cylinder and piston, in order to conserve space and reduce wear on the seals.

SUMMARY OF THE INVENTION

A single-piston, multimode fluid displacement pump comprising an elongated chamber, a piston reciprocally mounted within the chamber, a driving mechanism axially aligned with the chamber and piston for accurately positioning the piston within the chamber so as to define a measured fluid displacement, and ports for aspirating and dispensing fluid.

The invention relates to a fluid displacement pump, and particularly to a fluid displacement pump with multimode operation, that is, capable of precisely dispensing both very small quantities of sample and substantially larger quantities of diluent or system fluid.

An object of the invention is to provide a fluid displacement pump with a single piston for accurately dispensing very small quantities of sample.

A second object of the invention is to provide a fluid displacement pump with a single piston for accurately dispensing substantially larger quantities of diluent.

A third object of the invention is to provide a fluid displacement pump with a single piston capable of accurately dispensing either very small quantities of sample or substantially larger quantities of diluent.

Still another object of the invention is to provide a fluid displacement pump with a very accurate precision driving mechanism which is substantially axially aligned with the cylinder and piston, thereby reducing wear on the seals and making the pump more compact.

Another object of the invention is to provide a precision driving mechanism with few moving pans that has very little slack or play in it, to enhance the precision and accuracy and reduce the number of moving mechanical parts.

DETAILED DESCRIPTION OF THE PREFERRED EMBODIMENTS

Figure 1:
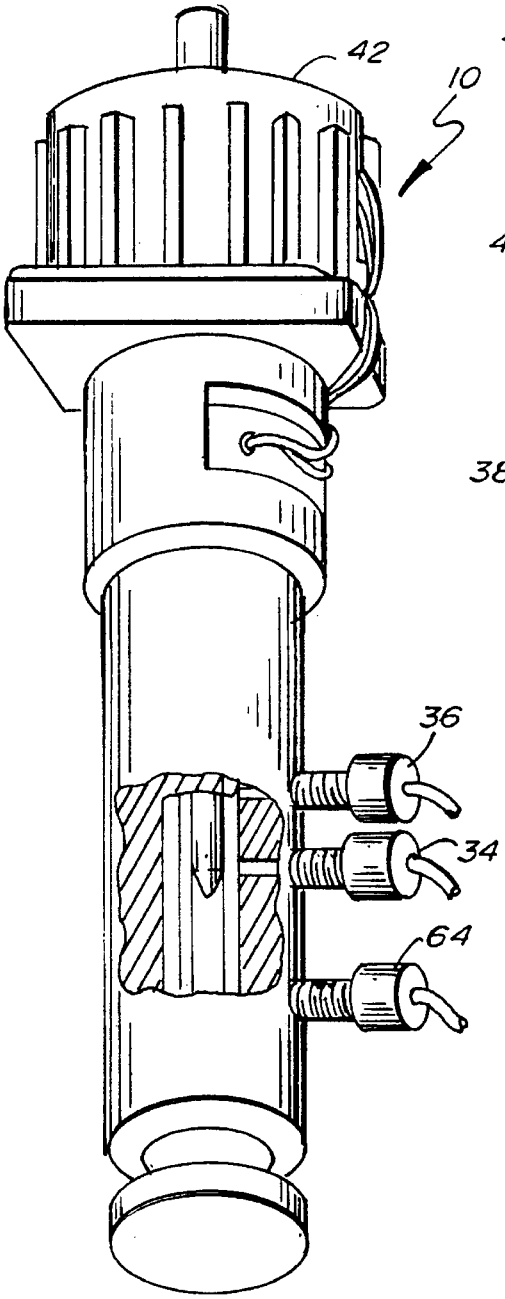
FIG. 1 is a perspective view of the fluid displacement pump.
Figure 2:
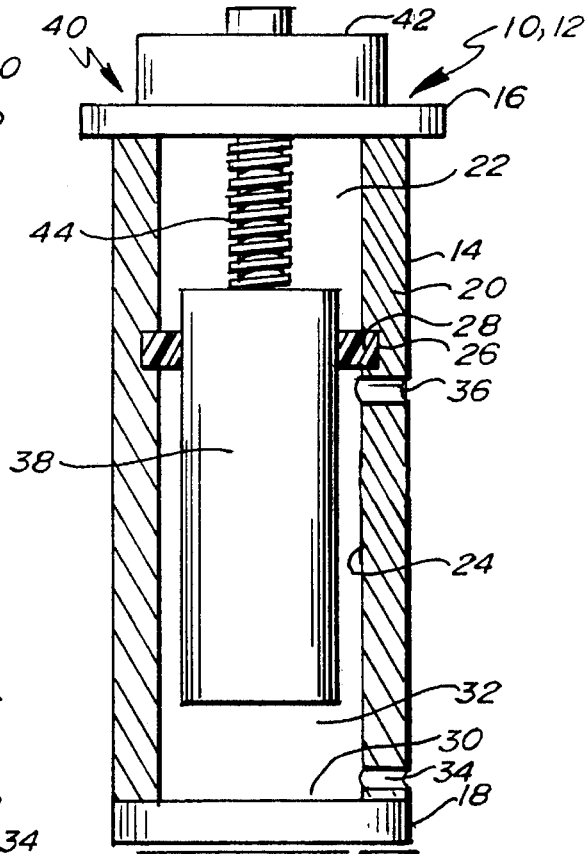
FIG. 2 is a partially broken away schematic of one preferred embodiment of the fluid displacement pump.

The multimode fluid displacement pump is shown generally as number 10 in the Figures. FIG. 2 shows a first embodiment 12 of the pump 10, which is used for aspirating and dispensing large volumes of fluid. The pump 10 has a housing 14, which comprises a top wall 16, bottom wall 18 and side wall 20. The top wall 16, bottom wall 18, and side wall 20 enclose an interior 22. The inner surface 24 of the side wall 20 has an annular means or groove 26 in which a seal 28 is mounted. The seal 28, the inner surface 24 of the side wall 20, and the inner surface 30 of the bottom wall 18 form a chamber 32. The chamber 32 has a first port 34 and a second port 36 for aspirating and dispensing fluids. Mounted reciprocally within the chamber 32 and sliding through the seal 28 is a piston 38.

The piston 38 is driven and accurately positioned longitudinally within the chamber 32 by a positioning means 40. In the preferred embodiment, the positioning means 40 comprises linear actuator or a stepper motor 42 and a lead screw 44, the lead screw being connected to the piston 38. In the preferred embodiment, the positioning means 40 is substantially axially aligned with the chamber 32 and piston 38.

In operation of the first embodiment 12, fluid is aspirated into the chamber 32 by actuating the motor 42 and lead screw 44 to withdraw the piston 38 from the chamber 32. This movement creates a partial vacuum in the chamber 32, allowing fluid to flow into the chamber 32 through the first port 34. The amount of fluid aspirated is equal to $\Pi r_1^2 x$, where $r_1$ is the radius of the piston 38 and x is the distance by which the piston is withdrawn. The distance x can be controlled very accurately by the stepper motor and lead screw. Fluid is dispensed by advancing the piston 38 into the chamber 32, forcing fluid out of the pump through the second port 36. The operation of the first port 34 and second port 36 is controlled by a valve (not shown) which permits fluid to enter through the first port 34 and exit through the second port 36. The pump is first primed with fluid, by aspirating and dispensing fluid as described above, to remove all air before operation begins.

Figure 3:
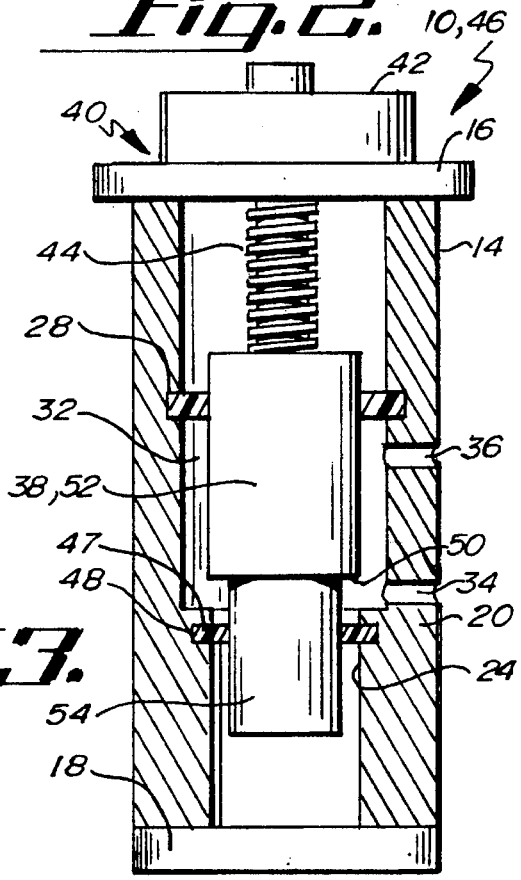
FIG. 3 is a partially broken away schematic of a second preferred embodiment of the fluid displacement pump.

FIG. 3 shows a second embodiment 46 of the pump 10, used for aspirating and dispensing small volumes of fluid, wherein the chamber 32 is defined by seal 28 in annular groove 26 at the end of the chamber 32 nearest the positioning means 40, and second seal 47 in a second annular groove 48 in the inner surface 24 of the side wall 20 at the end of the chamber 32 nearest the bottom wall 18. The piston 38 further comprises a rod 38 with a step 50, thereby forming a larger diameter segment 52 and a smaller diameter segment 54. The step 50 may be machined so as to create a range of differences in diameter between the larger diameter segment 52 and smaller diameter segment 54, thereby creating a range of fluid displacements. Preferably, the chamber 32 is made narrower at some point along its length so as to accommodate and firmly grip the smaller diameter segment 54 by the second seal 47. Alternatively, the outer diameter of seal 47 may be larger than seal 28 rather than changing chamber dimensions. The chamber 32 has a first port 34 and a second port 36 for aspirating and dispensing fluids.

The piston 38 is driven and accurately positioned longitudinally within the chamber 32 by a positioning means 40. In the preferred embodiment, the positioning means 40 comprises a stepper motor 42 and a lead screw 44, the lead screw being connected to the piston 38. In the preferred embodiment, the positioning means 40 is substantially axially aligned with the chamber 32 and piston 38.

In operation of the second embodiment 46, fluid is aspirated into the chamber 32 by actuating the motor 42 and lead screw 44 to withdraw the larger diameter segment 52 from the chamber 32. This movement creates a partial vacuum in the chamber 32, allowing fluid to flow into the chamber 32 through the first port 34. The amount of fluid aspirated is equal to $(\Pi r_1^2-\Pi r_2^2)x$, where $r_1$ is the radius of the larger diameter segment, $r_2$ is the radius of the smaller diameter segment, and x is the distance by which the larger diameter is withdrawn. The distance x can be controlled very accurately by the stepper motor and lead screw. Fluid is dispensed by advancing the larger diameter segment into the chamber 32, forcing fluid out of the pump through the second port 36. The operation of the first port 34 and second port 36 is controlled by a valve (not shown) which permits fluid to enter through the first port 34 and exit through the second port 36. The pump is first primed with fluid, by aspirating and dispensing fluid as described above, to remove all air before operation begins.

Figure 4:
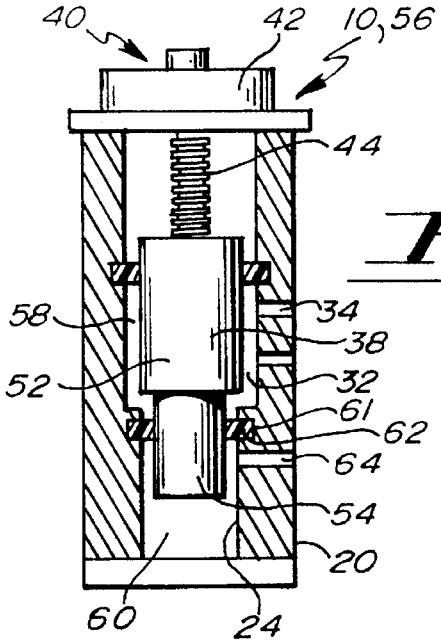
FIG. 4 is a partially broken away schematic of a third preferred embodiment of the fluid displacement pump.

FIG. 4 shows a third embodiment 56 of the pump 10, used for dispensing both large and small quantities of fluid, wherein there is a first (small) chamber 58 in which the larger diameter segment 52 and the smaller diameter segment 54 reciprocate together, and a second (large) chamber 60 in which the smaller diameter segment 54 reciprocates. The first (small) chamber 58 is separated from the second (large) chamber 60 by the seal 61 in an annular groove 62 in the inner surface 24 of the side wall 20 and by the smaller diameter segment 54. The first (small) chamber 58 has a first port 34 and a second port 36 for aspirating and dispensing fluids. The second (large) chamber 60 has a third port 64 for aspirating and dispensing fluids. It will be seen that the larger diameter segment 52 and smaller diameter segment 54 define a first fluid displacement volume in the first (small) chamber 58 equal to the difference between the volume of the larger diameter segment 52 and the volume of the smaller diameter segment 54. The smaller diameter segment 54 defines a second fluid displacement volume in the second (large) chamber 60 equal to the volume of the smaller diameter segment 54.

Figure 5:
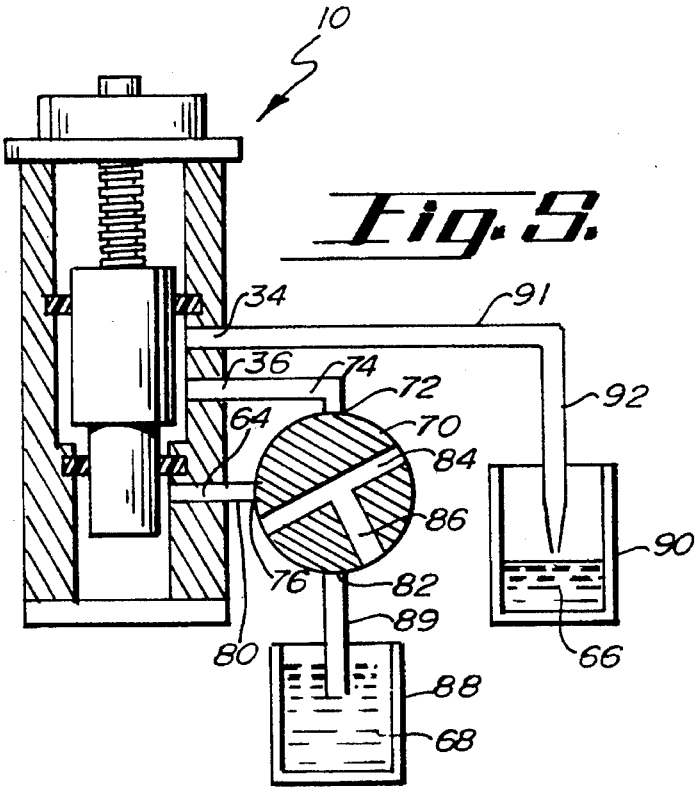
FIG. 5 is a partially broken away schematic of the fluid displacement pump in a complete system for dispensing the sample and diluent.

FIG. 5 shows the fluid displacement pump 10 in a complete system for aspirating and dispensing the sample 66 and diluent 68. The flow of fluids through the first port 34, second port 36, and third port 64 is controlled by a valve 70. The valve 70 has a first valve conduit 72 connected to the second port 36 of the pump 10 by tubing 74, and a second valve conduit 76 connected to the third port 64 of the pump 10 by tubing 80. The valve 70 also has a third valve conduit 82 connected to a source of diluent 88 by tubing 89. The valve 70 also has a rotating T-connector 84 with arms 86 for interconnecting the various valve conduits. A source of sample 90 is connected to the first port 34 of the pump 10 by tubing 91 and pipette 92, as the pipette 92 dips into the sample 66.

The operation of the third embodiment will now be described. It will be seen that two different displacement volumes are available from the pump 10. As larger diameter segment 52 is advanced by the positioning means 40 into the first (small) chamber 58, a volume of fluid will be displaced equal to $(\Pi r_1^2-\Pi r_2^2)x$, where $r_1$ is the radius of the larger diameter segment, $r_2$ is the radius of the smaller diameter segment, and x is the distance by which the larger diameter segment 52 is advanced. The distance x may be controlled very accurately by the stepper motor 42 and lead screw 44, or other equivalent positioning means 40. As the smaller diameter segment 54 is advanced by the positioning means 40 into the second (large) chamber 60, the smaller diameter segment 54 will displace a volume of fluid equal to $\Pi r_2^2 x$, where $r_2$ is the radius of the smaller diameter segment and x is the distance by which the segment is advanced.

Figure 6:
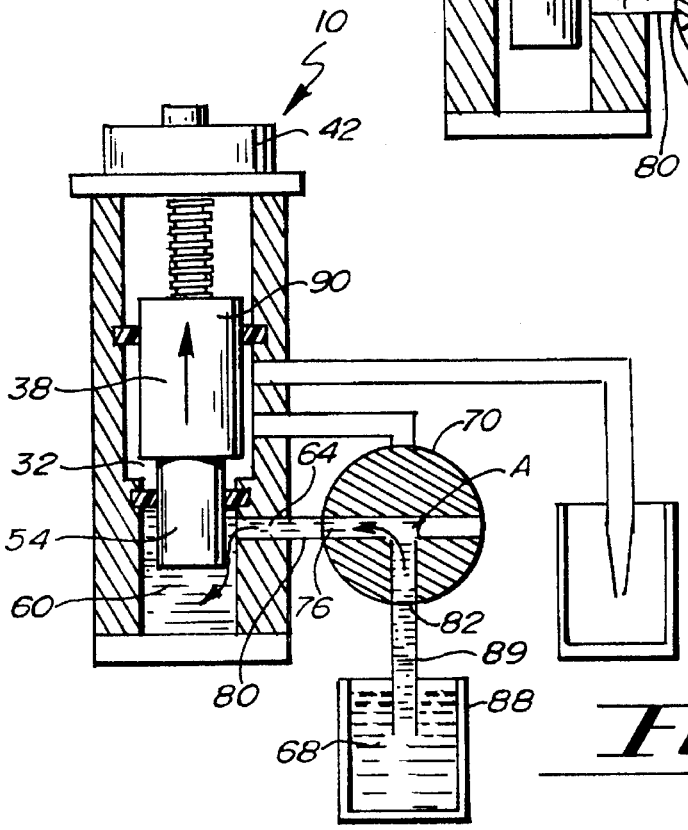
FIG. 6 shows the schematic operation of the pump in aspirating diluent to prime the pump.
Figure 7:
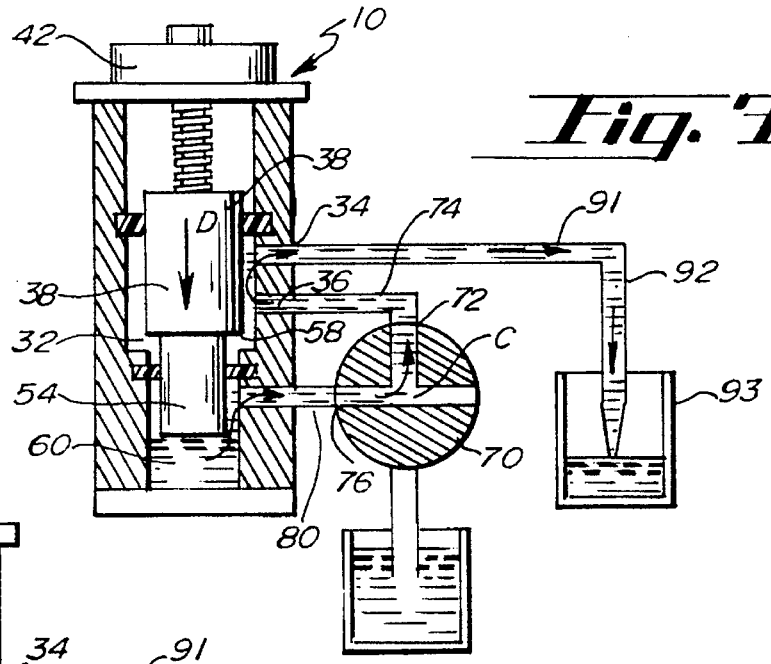
FIG. 7 shows the schematic operation of the pump in completing the priming cycle.

The pump 10 is initially primed as follows, as shown in FIG. 6 and FIG. 7. The valve 70 will make a connection A between the third valve conduit 82 and the second valve conduit 76 by positioning the T-connector 84 as shown. The smaller diameter segment 54 will be withdrawn from the second (large) chamber 60 by the motor 42 in the direction as shown by the arrow. As the smaller diameter segment 54 withdraws from the second (large) chamber 60, a partial vacuum will be created in the second (large) chamber 60, causing diluent 68 to flow from the source of diluent 88 through the tubing 89 and the third valve conduit 82, through the connection A in the valve 70, through the second valve conduit 76, tubing 80, and the third port 64 and into the second (large) chamber 60, as indicated by the curved arrows. As shown in FIG. 7, the valve 70 then breaks connection A and establishes a connection C between the second valve conduit 76 and the first valve conduit 72. The smaller diameter segment 54 is then advanced into the second (large) chamber 60 by the motor 42 in the direction shown by the arrow D. The piston thus forces air and diluent out of the second (large) chamber 60, through tubing 80 and the second valve conduit 76, through connection C in the valve 70, the first valve conduit 72, tubing 74, and second pump port 36 and into the first (small) chamber 58. Because the second displaced volume of (large) chamber 60 is much larger than the residual volume in the first (small) chamber 58, air and diluent will be forced out of the first (small) chamber 58 through the first port 34 and tubing 91 and pipette 92 and into the waste receptacle 93. The pump, valve, and all connecting portions will now contain only diluent, with no trapped air. This cycle may be repeated to eliminate air completely.

Figure 8:
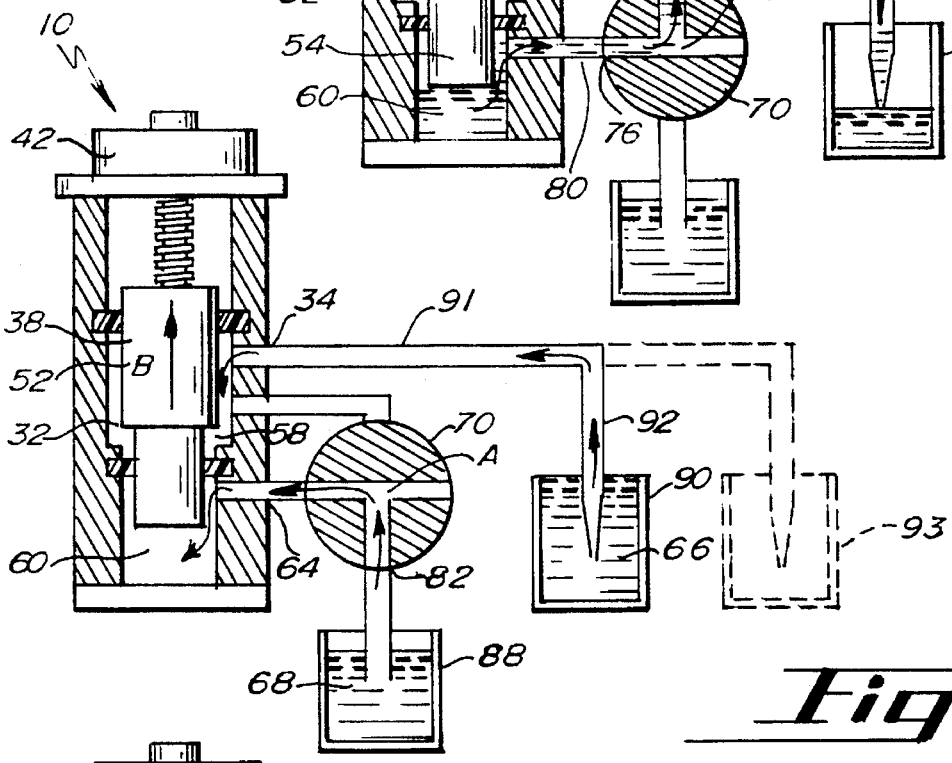
FIG. 8 shows the schematic operation of the pump in aspirating a small quantity of sample.

FIG. 8 shows the operation of the pump in aspirating a small quantity of sample. The valve 70 will establish connection A between the third valve conduit 82 and the third port 64. The motor 42 will withdraw the larger diameter segment 52 from the from the first (small) chamber 58, in the direction show by the arrow B. As the larger diameter segment 52 withdraws, a small volume of sample 66 equal to $(\Pi r_1^2-\Pi r_2^2)x$ as discussed above will be drawn into the first (small) chamber 58 through the pipette 92, tubing 91, and first port 34 from the sample source 90. Concurrently, a volume of diluent 68 will be drawn into the second (large) chamber 60. All or part of the sample in the first (small) chamber 58 may now be dispensed through the first port 34 by advancing the piston 38 a known distance, with the sample source 90 being replaced by a receptacle 93. At the same time, diluent will be returned from the second (large) chamber 60 through connection A to the source of diluent 88.

Figure 9:
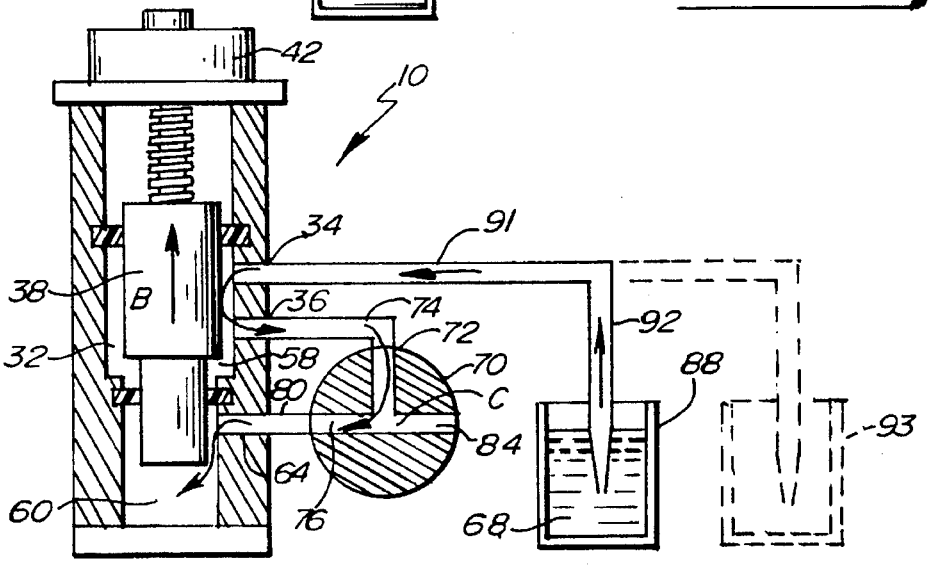
FIG. 9 shows the schematic operation of the pump in aspirating a large quantity of diluent.

FIG. 9 shows the operation of the pump in aspirating a large quantity of diluent. The valve 70 will establish connection C between the first valve conduit 72 and the second valve conduit 76. As the piston 38 is withdrawn from the first (small) chamber 58 and second (large) chamber 60 by the motor 42 in the direction of the arrow B, a volume of diluent 68 from the source of diluent 88 will be drawn through the pipette 92, tubing 91, first port 34, second port 36, tubing 74, first valve conduit 72, T-connector 84, second valve conduit 76, tubing 80, and third port 64 into the first (small) chamber 58 and second (large) chamber 60. The maximum volume aspirated will equal the sum of the volumes displaced in the first (small) chamber 58 and the second (large) chamber 60, that is $(\Pi r_1^2-\Pi r_2^2)x+\Pi r_2^2x=\Pi r_1^2$. The diluent may now be dispensed by advancing the piston 38, with the source of diluent 88 being replaced with a receptacle 93 for receiving the diluent.

It will be seen that a multi-mode fluid displacement pump with a single piston has been described. Several embodiments have described. In a first embodiment, the single piston is of the same diameter throughout its length, reciprocating in a single chamber. In the second embodiment, the piston is tapered so as to comprise a rod with segments of two different diameters. This produces a pump with a fluid displacement equal to the difference in volumes of the segments. In a third embodiment, a second chamber is added, so as to provide two different displacements with the same pump. In all embodiments, the piston is preferably driven by a stepper motor and lead screw arrangement which is axially aligned with the piston and chamber. The pump has the advantage of being able to very accurately dispense either very small volumes of sample or larger volumes of diluent, or both at the same time. A further advantage is that the precision driving mechanism is axially aligned with the piston and chamber and the two seals which assist in alignment and reduced wear, thereby producing less strain and wear on the seals and occupying less space. Furthermore, the stepper motor and lead screw arrangement has less slack or play in it than a pulley and drive belt arrangement.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A fluid displacement pump, comprising:

(a) a housing, having a top wall, bottom wall, and side wall, the bottom wall and side wall each having an inner surface, the top wall, bottom wall, and side wall enclosing an interior therebetween, (b) means in the inner surface of the side wall for carrying a seal therein, (c) an elongated chamber, formed by the inner surface of the bottom wall, inner surface of the side wall, and the seal, having a piston reciprocally mounted therein, the piston sliding through the seal, (d) means for accurately positioning the piston within the chamber so as to measure a fluid displacement, wherein the positioning means further comprises a stepper motor and a lead screw, and (e) two ports for aspirating and dispensing fluid from the chamber wherein the positioning means is substantially axially aligned with the piston and chamber.

2. The pump as in claim 1, wherein the piston comprises a single stepped rod with a larger diameter segment and a smaller diameter segment, and wherein the piston defines a first fluid displacement equal to the diameter of the larger diameter segment minus the diameter of the smaller diameter segment times the length of piston inserted into said chamber.

3. The pump as in claim 2, wherein the chamber is sealed by seals through which a segment slides.

4. The pump as in claim 2, wherein the chamber is narrowed so as to accommodate and firmly grip the smaller diameter segment.

5. The pump as in claim 2, wherein the positioning means is substantially axially aligned with the piston and chamber.

6. The pump as in claim 5, wherein the positioning means further comprises a stepper motor and a lead screw.

7. The pump as in claim 2, wherein the elongated chamber further comprises a first chamber and a second chamber, separated from each other by a seal through which one of the segments slides, and wherein said first fluid displacement is defined in the first chamber and a second fluid displacement is defined in the second chamber equal to the volume of one of the segments, the pump being capable of aspirating or dispensing either the first fluid displacement or the second fluid displacement or both fluid displacements in a single stroke.

8. The pump as in claim 7, wherein the positioning means is substantially axially aligned with the chamber and piston.

9. The pump as in claim 8, wherein the positioning means further comprises a stepper motor and a lead screw.

10. The pump as in claim 7, wherein the chamber is narrowed so as to accommodate and firmly grip the smaller diameter segment.

11. A fluid displacement pump, comprising:

(a) a housing, having a top wall, bottom wall, and side wall, the bottom wall and side wall each having an inner surface, the top wall, bottom wall, and side wall enclosing an interior therebetween, (b) a first means in the inner surface of the side wall for carrying a first seal therein, (c) a second means in the inner surface of the side wall for carrying a second seal therein, (d) an elongated chamber, formed by the inner surface of the side wall, the first seal, and the second seal, having a piston reciprocally mounted therein, (e) the piston further comprising a single stepped rod with a larger diameter segment and a smaller diameter segment, and wherein the piston defines a fluid displacement equal to the diameter of the larger diameter segment minus the diameter of the smaller diameter segment times the length of piston inserted into said chamber, the smaller diameter segment sliding through the second seal, (f) means for accurately positioning the piston within the chamber so as to measure the fluid displacement, and (g) two ports for aspirating and dispensing fluid from the chamber.

12. The pump as in claim 11, wherein the positioning means is substantially axially aligned with the piston and chamber.

13. The pump as in claim 12, wherein the positioning means further comprises a stepper motor and a lead screw.

14. A fluid displacement pump, comprising:

(a) a housing, having a top wall, bottom wall, and side wall, the bottom wall and side wall each having an inner surface, the top wall, bottom wall, and side wall enclosing an interior therebetween, (b) a first means in the inner surface of the side wall for carrying a first seal therein, (c) a second means in the inner surface of the side wall for carrying a second seal therein, (d) a first chamber, formed by the inner surface of the side wall, the first seal, and the second seal, having a piston reciprocally mounted therein, (e) the piston further comprising a single stepped rod with a larger diameter segment and a smaller diameter segment, and wherein the piston defines a first fluid displacement in the first chamber equal to the diameter of the larger diameter segment minus the diameter of the smaller diameter segment times the length of piston inserted into said first chamber, (f) a second chamber, sealed from the first chamber, formed by the inner surface of the side wall, the inner surface of the bottom wall, and the second seal, and wherein a second fluid displacement is defined in the second chamber equal to the volume of the smaller diameter segment, and wherein the smaller diameter segment slides through the second seal, and (g) means for accurately positioning the piston within the chamber so as to measure the fluid displacements, and (h) three ports for aspirating and dispensing fluid from the first chamber and second chamber, the pump being capable of aspirating or dispensing either the first fluid displacement or the second fluid displacement or both fluid displacements in a single stroke.

15. The pump as in claim 14, wherein the positioning means is substantially axially aligned with the piston and chamber.

16. The pump as in claim 15, wherein the positioning means further comprises a stepper motor and a lead screw.

17. A fluid displacement pump for selectively dispensing precise quantities of two fluids, comprising:

(a) a housing, having a top wall, bottom wall, and side wall, the bottom wall and side wall each having an inner surface, the top wall, bottom wall, and side wall enclosing an interior therebetween, (b) a first means in the inner surface of the side wall for carrying a first seal therein, (c) a second means in the inner surface of the side wall for carrying a second seal therein, (d) a first chamber, formed by the inner surface of the side wall, the first seal, and the second seal, having a piston reciprocally mounted therein, (e) the piston further comprising a single stepped rod with a larger diameter segment and a smaller diameter segment, and wherein the piston defines a first fluid displacement in the first chamber equal to the diameter of the larger diameter segment minus the diameter of the smaller diameter segment times the length of piston inserted into said first chamber, (f) a second chamber, sealed from the first chamber, formed by the inner surface of the side wall, the inner surface of the bottom wall, and the second seal, and wherein a second fluid displacement is defined in the second chamber equal to the volume of the smaller diameter segment, and wherein the smaller diameter segment slides through the second seal, (g) means for accurately positioning the piston within the chamber so as to measure the fluid displacements, (h) three ports for aspirating and dispensing the fluids from the first chamber and second chamber, and (i) valve means for controlling the pump to allow the first chamber to dispense one fluid and the second chamber to dispense a different fluid the pump being capable of aspirating or dispensing either the first fluid displacement or the second fluid displacement or both fluid displacements in a single stroke.

18. The pump as in claim 17, wherein the positioning means is substantially axially aligned with the piston and chamber.

19. The pump as in claim 18, wherein the positioning means further comprises a stepper motor and a lead screw.

* * * * *

US005540562C1

(12) EX PARTE REEXAMINATION CERTIFICATE (5930th)

United States Patent
Giter

(10) Number: US 5,540,562 C1
(45) Certificate Issued: Oct. 9, 2007

(54) SINGLE-PISTON, MULTI-MODE FLUID DISPLACEMENT PUMP

(75) Inventor: Gerston Giter, St. Paul, MN (US)

(73) Assignee: Dmitry Volovik, St. Paul, MN (US)

Reexamination Request:
No. 90/006,942, Feb. 18, 2004

Reexamination Certificate for:

| | |
|---|---|
| Patent No.: | **5,540,562** |
| Issued: | **Jul. 30, 1996** |
| Appl. No.: | **08/234,282** |
| Filed: | **Apr. 28, 1994** |

(51) Int. Cl.

| | |
|---|---|
| ***F04B 3/00*** | (2006.01) |
| ***F04B 5/00*** | (2006.01) |
| ***F04B 25/00*** | (2006.01) |
| ***F04B 49/06*** | (2006.01) |

(52) U.S. Cl. ..... 417/254
(58) Field of Classification Search ..... 417/254, 417/419
See application file for complete search history.

(56) References Cited

U.S. PATENT DOCUMENTS

| | | | | |
|---|---|---|---|---|
| 4,089,624 | A | 5/1978 | Nichols et al. | 417/362 |
| 4,775,481 | A | 10/1988 | Allington | 210/656 |
| 4,888,998 | A | 12/1989 | Buzza et al. | 73/864.21 |
| 5,219,099 | A | 6/1993 | Spence et al. | 222/325 |
| 5,253,981 | A | 10/1993 | Yang et al. | 417/3 |
| 5,312,233 | A | 5/1994 | Tanny et al. | 417/316 |
| 5,358,691 | A | 10/1994 | Clark et al. | 422/64 |
| 5,516,429 | A | 5/1996 | Snodgrass et al. | 210/767 |
| 5,536,471 | A | 7/1996 | Clark et al. | 427/63 |
| 5,637,208 | A | 6/1997 | Dourdeville | 210/90 |

FOREIGN PATENT DOCUMENTS

| | | |
|---|---|---|
| EP | 0 039 146 | 4/1981 |
| JP | 2-213729 | 8/1990 |
| WO | WO 88/07712 | 10/1988 |

OTHER PUBLICATIONS

Alexander H. Slocum, Precision Machine Design, (1992), pp. 705–733.

*Primary Examiner*—Jeanne Clark

(57) ABSTRACT

A single-piston, multimode fluid displacement pump comprising an elongated chamber, a piston reciprocally mounted within the chamber, a driving mechanism axially aligned with the chamber and piston for accurately positioning the piston within the chamber so as to define a measured fluid displacement, and ports for aspirating and dispensing fluid.

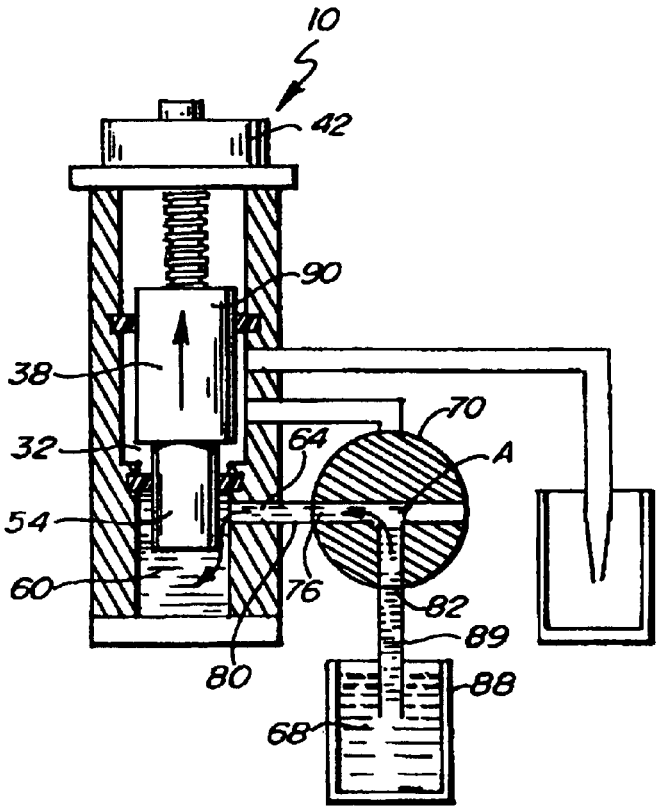

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–19 is confirmed.

* * * * *